US009322212B2

(12) United States Patent
Drifka

(10) Patent No.: US 9,322,212 B2
(45) **Date of Patent: *Apr. 26, 2016**

(54) WIND LOCK CONFIGURATION FOR OVERHEAD ROLL-UP DOORS

(71) Applicant: Rytec Corporation, Jackson, WI (US)

(72) Inventor: Brian Norbert Drifka, Richfield, WI (US)

(73) Assignee: RYTEC CORPORATION, Jackson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/518,116

(22) Filed: Oct. 20, 2014

(65) Prior Publication Data

US 2015/0101765 A1 Apr. 16, 2015

Related U.S. Application Data

(63) Continuation of application No. 13/240,446, filed on Sep. 22, 2011, now Pat. No. 8,887,790.

(60) Provisional application No. 61/534,356, filed on Sep. 13, 2011.

(51) Int. Cl.

| | |
|---|---|
| ***E06B 9/56*** | (2006.01) |
| ***E06B 9/58*** | (2006.01) |
| ***E05D 15/16*** | (2006.01) |
| ***E06B 9/13*** | (2006.01) |
| ***E06B 7/232*** | (2006.01) |

(52) U.S. Cl.

CPC ..... *E06B 9/581* (2013.01); *E05D 15/165* (2013.01); *E06B 7/232* (2013.01); *E06B 9/13* (2013.01); *E06B 9/56* (2013.01); *E06B 9/582* (2013.01); *E05Y 2900/00* (2013.01); *E05Y 2900/106* (2013.01); *E05Y 2900/132* (2013.01); *E06B 2009/585* (2013.01); *E06B 2009/587* (2013.01); *E06B 2009/588* (2013.01); *Y10T 428/24488* (2015.01)

(58) Field of Classification Search

CPC ..... E06B 9/581; E06B 9/13; E06B 9/582
USPC ..... 160/271, 272, 273.1, 41, 42, 264, 160/268.1, 270, 265

See application file for complete search history.

(56) References Cited

U.S. PATENT DOCUMENTS

| | | | | |
|---|---|---|---|---|
| 3,489,200 | A * | 1/1970 | Recchione | 160/133 |
| 3,864,203 | A * | 2/1975 | Marzocchi | 523/203 |
| 4,357,978 | A * | 11/1982 | Keller et al. | 160/41 |
| 4,478,268 | A * | 10/1984 | Palmer | 160/310 |
| 4,601,320 | A * | 7/1986 | Taylor | 160/271 |

(Continued)

*Primary Examiner* — Katherine Mitchell
*Assistant Examiner* — Johnnie A Shablack
(74) *Attorney, Agent, or Firm* — Factor Intellectual Property Law Group, Ltd.

(57) ABSTRACT

An overhead roll-up door assembly for a vertically moving door to permit and prohibit access to an opening, the door assembly having a pair of spaced apart, parallel side columns for vertically guiding a door panel, the door panel having at least one wind lock attached proximate each marginal edge of the door panel, each of the wind locks having an angled portion facing the interior of the opening having a first durometer and a substantially rectangular portion having a second durometer different from the first durometer, the wind locks engaging the side column to prevent disengagement of the door panel from the side columns when a wind load is applied to the door panel.

18 Claims, 7 Drawing Sheets

(56) References Cited

U.S. PATENT DOCUMENTS

| | | | | | |
|---|---|---|---|---|---|
| 4,601,321 | A * | 7/1986 | Tokui et al. | 164/155.5 |
| 4,609,981 | A * | 9/1986 | Gamba | 363/22 |
| 4,649,981 | A * | 3/1987 | Bibeau | 160/120 |
| 4,690,195 | A * | 9/1987 | Taylor | 160/310 |
| 4,987,943 | A * | 1/1991 | Charest | 160/269 |
| 5,058,651 | A * | 10/1991 | Ashley et al. | 160/271 |
| 5,131,450 | A * | 7/1992 | Lichy | 160/310 |
| 5,163,495 | A * | 11/1992 | Lichy | 160/273.1 |
| 5,365,993 | A * | 11/1994 | Jella | 160/201 |
| 5,379,823 | A * | 1/1995 | Kraeutler | 160/271 |
| 5,379,832 | A * | 1/1995 | Dempsey | 165/110 |
| 5,392,836 | A * | 2/1995 | West et al. | 160/273.1 |
| 5,445,209 | A * | 8/1995 | Lichy | 160/273.1 |
| 5,482,104 | A * | 1/1996 | Lichy | 160/273.1 |
| 5,657,805 | A * | 8/1997 | Magro | 160/133 |
| 5,964,270 | A * | 10/1999 | Kirkey et al. | 160/273.1 |
| 6,065,525 | A * | 5/2000 | Wells | 160/273.1 |
| 6,068,040 | A * | 5/2000 | Magro et al. | 160/133 |
| 6,152,208 | A * | 11/2000 | Kalempa et al. | 160/273.1 |
| 6,341,639 | B1 * | 1/2002 | Mullet et al. | 160/267.1 |
| 6,390,171 | B2 * | 5/2002 | Drifka et al. | 160/23.1 |
| 6,431,250 | B2 * | 8/2002 | Mullet et al. | 160/273.1 |
| 6,574,832 | B1 * | 6/2003 | Boerger et al. | 16/90 |
| 6,722,416 | B2 * | 4/2004 | Varley et al. | 160/264 |
| 6,942,003 | B2 * | 9/2005 | Thompson | 160/268.1 |
| 7,028,738 | B2 * | 4/2006 | Ceccofiglio | 160/133 |
| 7,275,581 | B2 * | 10/2007 | Coenraets | 160/273.1 |
| 7,464,743 | B1 * | 12/2008 | Berger, Jr. | 160/273.1 |
| 7,516,770 | B2 * | 4/2009 | Jerry | 160/267.1 |
| 7,581,578 | B2 * | 9/2009 | Coenraets | 160/267.1 |
| 7,748,431 | B2 * | 7/2010 | Jansen et al. | 160/268.1 |
| 7,793,702 | B2 * | 9/2010 | Biewer et al. | 160/370.22 |
| 8,109,317 | B2 * | 2/2012 | Bostyn | 160/273.1 |
| 8,291,960 | B2 * | 10/2012 | Bowman | 160/267.1 |
| 8,887,790 | B2 * | 11/2014 | Drifka | 160/273.1 |
| 2006/0144530 | A1 * | 7/2006 | Nagare et al. | 160/271 |
| 2008/0035282 | A1 * | 2/2008 | Coenraets | 160/272 |
| 2008/0093037 | A1 * | 4/2008 | Kraeutler | 160/271 |
| 2009/0145559 | A1 * | 6/2009 | Glasl et al. | 160/273.1 |
| 2010/0000692 | A1 * | 1/2010 | Coenraets | 160/323.1 |
| 2010/0288452 | A1 * | 11/2010 | Coenraets | 160/309 |
| 2010/0326607 | A1 * | 12/2010 | Kitani et al. | 160/268.1 |
| 2011/0259530 | A1 * | 10/2011 | Brook et al. | 160/120 |
| 2012/0241105 | A1 * | 9/2012 | Drifka et al. | 160/133 |
| 2012/0241107 | A1 * | 9/2012 | Gontarski et al. | 160/236 |
| 2012/0241109 | A1 * | 9/2012 | Drifka | 160/264 |
| 2012/0241110 | A1 * | 9/2012 | Drifka et al. | 160/271 |
| 2012/0325416 | A1 * | 12/2012 | Hayashiguchi | 160/272 |
| 2013/0061525 | A1 * | 3/2013 | Drifka | 49/197 |
| 2014/0190097 | A1 * | 7/2014 | Drifka et al. | 52/204.1 |

* cited by examiner

FIG. 5A
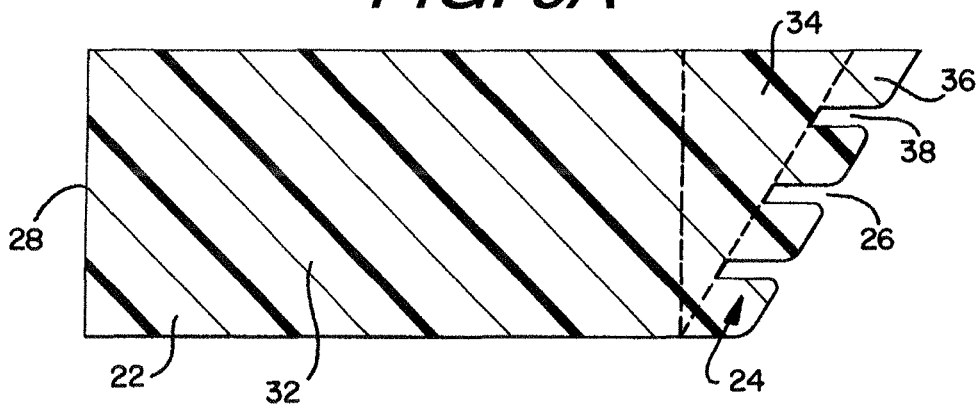
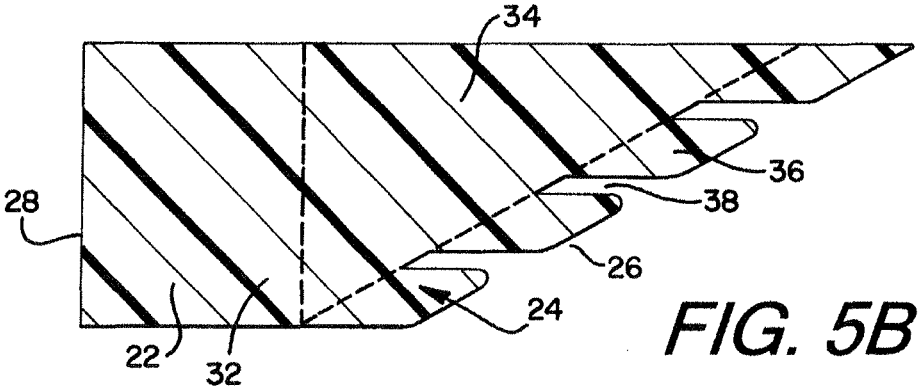
FIG. 5B
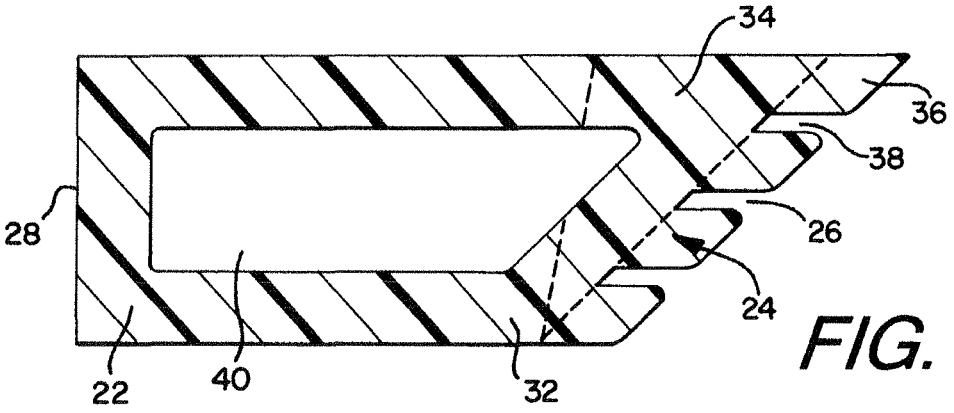
FIG. 5C

FIG. 5D
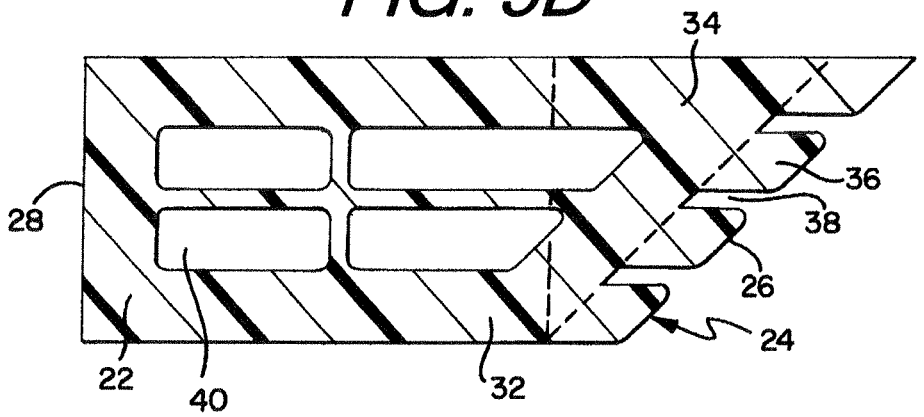
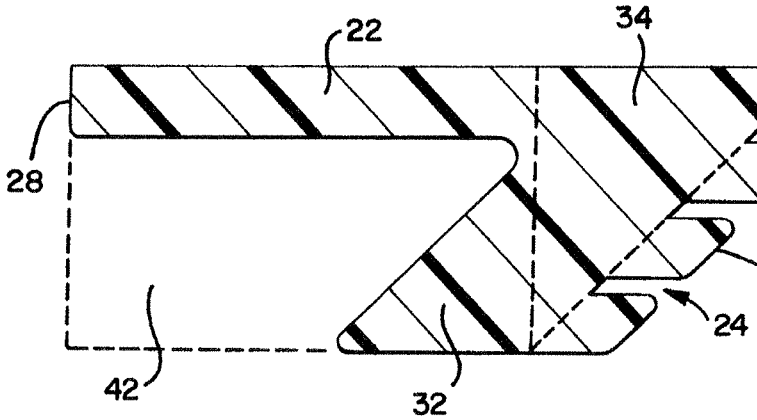
FIG. 5E
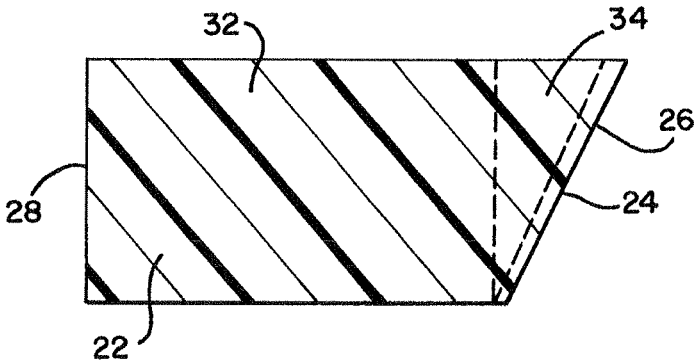
FIG. 5F

WIND LOCK CONFIGURATION FOR OVERHEAD ROLL-UP DOORS

RELATED APPLICATIONS

This application is a continuation of U.S. patent application Ser. No. 13/240,446 entitled "Wind Lock Configuration For Overhead Roll-Up Doors" filed Sep. 22, 2011, which claims priority to U.S. Provisional Application Ser. No. 61/534,356 entitled "Continuous Wind Lock Configuration For Overhead Roll-Up Door" filed Sep. 13, 2011, the contents of both of which are fully incorporated herein by reference.

FIELD OF THE INVENTION

The present invention is related to overhead roll-up doors, and more specifically to an overhead roll-up door having a door panel with a thickened edge wind lock for preventing the door panel from inadvertently disengaging with the door assembly from the force of wind, while allowing the door panel to disengage should it be impacted by an object.

BACKGROUND OF THE INVENTION

In environments where overhead roll-up doors are used, there are two transverse forces which must be accounted for to insure proper and safe function of the door as the door panel travels vertically in the side columns bounding the path of travel for the door panel.

The first of these transverse forces that must be accounted for is a wind force or a wind load applied to the door panel, particularly as the door opens and closes. This transverse force typically results from a wind blowing against the door panel, and is particularly concerning when the door panel is opening or closing as the door panel may be blown out of its path of travel. If the door panel does not contain enough wind resistance to overcome the wind load applied to it, the door panel will disengage from the side columns, leading to the door unexpectedly opening or not properly opening or closing, and potentially damaging the door and any objects or persons located proximate the door panel. In order to combat this force and to increase the wind load, the door and door panel can withstand, the opposing side edges of the door panel may include a continuous thickened edge which engages the corresponding side column to prevent the door panel from blowing out when the door panel is confronted with a low, moderate, or even high wind load. However, if located in a high-wind area, these thickened edges may become severely worn and damaged over time—as constant and/or substantial wind blowing against the door panel may cause the thickened edges to continuously engage the side columns, substantially increasing the frictional forces between the side column and the thickened edges, particularly as the door panel opens and closes. As a result, the thickened edges may engage the side columns as the door panel is moved vertically between the opened and closed position, inhibiting door panel movement and substantially increasing wear.

The second of these transverse forces which must be accounted for is the force created when an object, like for example a forklift truck or a flat back truck, hits or impacts the door panel, usually as the door panel is opening or closing. In order to avoid damage to the object striking the door panel, the door panel, and any other door structures, like for example a bottom bar attached proximate the bottom edge of the door panel, the side columns, or a motor driving the door panel, it is desired that these doors be designed to "breakaway" so that the door panel is released from the side columns and pushed out from the resulting impact force. This breakaway ability, however, may be lessened or severely limited due to the friction between the thickened side edges and side columns when the door is impacted. Just as when a wind force or wind load is applied to the door, the application of an impact force from an object may cause the thickened edges to engage, or further engage, the side columns, creating a frictional force which acts to keep the door panel in place. While angling the innermost faces of the thickened edges that engage the side columns and/or a portion of the side columns that engage the thickened edges may facilitate the disengagement of the door panel from the side columns, there nevertheless is increased friction that may prevent the door panel from fully disengaging.

An additional problem related to the second transverse force and continuous thickened edges is that the edges may stick or jam in the side columns when the door panel is impacted, preventing the door panel from releasing from the side columns. If the continuous thickened edges become jammed in the side columns, because for example they are too thick or friction prevents their complete escape, the ability of the door to disengage from the side columns may be greatly compromised. If these thickened side edges become stuck or jammed in the side column when the door panel is struck, the sticking or jamming may damage the door panel, the thickened edges, or the side column, and may further prevent the motor from raising the door panel, potentially damaging the motor and preventing any self-repair features of the door panel from working. Once damaged, in order to repair the doors and get the door panel moving again, frequently a portion of the side column must be removed so the continuous thickened edge can be un jammed and placed back in the path of travel in the side column, and any door components which were damaged must be removed and replaced before full operation may be resumed.

In order to prevent unwanted wear from friction on these continuous thickened edges, and to further enhance the disengage-ability of the door panel when it is impacted by an object, it is known in the art to bond an ultra high molecular weight ("UHMW") plastic strip, or more likely strips, to an angled face of the thickened edge which engages the side columns. While these plastic strips may reduce friction between the thickened edges and the side columns—thereby reducing the wear on the thickened edges and facilitating the disengagement of the edges and side columns when necessary—UHMW plastic strips have numerous drawbacks. First, bonding the plastic strip(s) to the door panel is highly labor intensive inasmuch as the strips must be broken apart sufficiently small and properly spaced to insure the door panel will properly wind up on the drum in a manner where the strip(s) do not enlarge the rolled door an overly inconvenient amount. A larger roll size when the door is in the substantially opened position results in a larger header for the door to house the rolled panel, thereby creating a smaller doorway or opening through which objects may travel. Second, because they are bonded and are a non-continuous piece, these plastic strip(s) contain edges or corners which are commonly caught and can tear or be peeled off entirely, creating an area which may be less disengage-able, leading to damage to the door panel, the side column, or any other door components if the door panel is impacted and cannot fully release. In order to replace any damaged or removed strips, the door panel must be disengaged from the side column, and a person must replace each strip individually by hand.

A third drawback to using UHMW plastic strips related to the tearing and peeling of the strip(s) is that adhesive must be used which may lead to an increase in the frictional forces recognized by the door, or worse hold the door panel in place if any of the strip(s) become torn or removed from the thickened edge. Adhesive remaining on the thickened edge after a plastic strip(s) is torn or removed may increase the friction between the thickened edge portion where the strip(s) has been removed or even form a bond between the thickened edge and side column locking the thickened edge and door panel in place. Additionally, before operation of a repaired door panel may begin, it may be necessary to properly clean at least a portion of the side column, to insure that no adhesive remains to prevent additional friction or sticking.

Another known method of preventing unwanted wear friction on these continuous thickened edges, and to further enhance the disengage-ability of the door panel when it is impacted by an object, is applying Polyethylene Terephthalate ("PET") fabric strips over an angled face of the thickened edge, wherein the angled face comprises the portion which engages the side column. While applying the PET fabric strips are less labor intensive than bonding separate UHMW plastic strips, it still requires an individual to bond the fabric strips to the thickened edges. In addition, like the UHMW plastic stripes, PET fabric strips also contain edges making the fabric strips susceptible to being torn or partially removed from the edge. Additionally, these fabric strips may become worn or cut over time, creating additional edges that may catch or tear on the fabric. These fabric strips may also buckle and separate from the thickened edge, creating further hazardous conditions. Like the UHMW plastic strips, repairing any torn or removed portions of the fabric strips requires removing the door panel from the side columns, and in many cases may require the removal and replacement of the entire damaged fabric strip.

It is also known in the art, that in order to maintain breakaway-ability, the thickened edges may be made of a pliable material or may be made to protrude perpendicularly from the door panel a small distance. However, utilizing either of these methods to maintain breakaway-ability reduces the wind load the door panel can withstand before being blown out of the side columns inasmuch as the thickened edges are either too weak or too small to withstand a full wind load. Conversely, if a rigid material is utilized for the thickened edges or the thickened edges protrude a great distance from the door panel, the thickened edges may not properly disengage, or may not disengage at all when the door panel is impacted. While altering the material and thickness of the thickened edges may improve the response to one of the two transverse forces, it will have a negative impact on the other force. Additionally, there is still the issue of friction and additional issues of concern with roll-up doors employing thickened edge wind locks.

Regardless of the application of UHMW plastic strips, PET fabric strips, or applying nothing at all to the thickened edges, and regardless of whether the thickened edges contain an angled face, utilization of a continuous thickened edge along each side of the door panel substantially increases the diameter of the door panel when it is substantially wound on the drum in a substantially open position. The larger diameter requires a larger header that consequently may result in a smaller opening and may lead to additional unwanted wear on the motor controlling the drum and the door. Additionally, the thickened edges may crease, buckle or otherwise bulge when the door panel is in the rolled-up position, potentially damaging the edges and substantially increasing the size of the rolled-up door panel.

Additionally, continuous thickened edges may increase the total weight of the door, creating additional stress on the motor controlling the door as it opens and closes.

In yet other door designs, in order to enhance the wind lock of the door panel while insuring breakaway-ability, small knobs or protrusions may be placed proximate opposing edges of the door panel. These knobs or protrusions typically engage a portion of a side column guiding the door panel, increasing the resistance of the door in response to force from wind or air pressure on the door. However, these knobs or protrusions may offer less resistance than is necessary in the face of a moderate or high wind load, and under extreme forces, like for example if the door or any of its components are impacted by an object, these knobs or protrusions may break off the door panel, eliminating any wind load resistance benefit they provide. In order to replace the knobs, a person must remove the door from the side column and individually replace each knob or protrusion.

It yet further designs, segmented or spaced apart thickened portions may be attached to the door panel proximate each edge. While these wind locks are generally successful in breaking away in a zipper like fashion when the door panel is impacted by an object, they too may have problems standing up to the highest of winds.

As such, it would be advantageous to create a door assembly having a door panel having a thickened edge wind lock capable of withstanding the highest wind loads while also allowing for the door panel to controllably break away should the door panel be impacted by an object.

It would be further advantageous if the thickened edges were capable of winding in a manner that reduces the size of the roll of the door panel when in a substantially open position.

It would be still another advantage if the thickened edges were configured so as to be lighter in weight, to reduce the stress on the motor and the door panel.

The present invention is directed to solving these and other problems.

SUMMARY OF THE INVENTION

The present invention is directed to an overhead roll-up door assembly having a door panel with a thickened edge wind lock for an overhead roll-up door capable of withstanding high wind loads while also being capable of disengaging from side columns guiding the door panel should the door panel be impacted by an object or excessive force, particularly when the door is opening or closing.

According to one aspect of the invention, an overhead roll-up door assembly for a vertically moving door is disclosed so as to permit and prohibit access to an opening. The overhead roll-up door assembly includes a door panel having two faces, a top edge, a bottom edge, and opposing marginal and lateral edges, a drum for winding and unwinding the door panel to permit and prohibit access to the opening, and a pair of opposing parallel side columns aligned and spaced apart such that the lateral and marginal edges of the door panel engage at least a portion of the side columns to guide the door vertically between the open and closed positions. Attached to the door panel, proximate each marginal edge, is at least one thickened edge wind lock, each of the wind locks extending away from one face of the door panel in a direction substantially perpendicular thereto. According to one aspect of the invention, these thickened edge wind locks run vertically from approximately the top edge or a top portion of the door panel to approximately the bottom edge or a bottom portion of the door panel. Alternatively, the wind locks may be segmented and spaced apart along each edge of the door panel. Regardless of whether the wind locks are continuous, substantially continuous, or segmented, the wind locks are configured to engage at least a portion of one of the side columns to prevent the door panel from disengaging from the side columns when a low, moderate, or high wind load is applied to the door panel.

According to another aspect of the invention, the thickened edge wind locks contain a substantially rectangular portion having a substantially straight face which aligns with the lateral edge of the door panel, and an angled portion facing the interior of the opening and configured to engage the side columns to keep the door panel within the side columns when presented with a wind load. The side columns may include a corresponding angled face for engaging an angled portion face of the angled portion of thickened edge in a manner which keeps the thickened edge and door panel in the side column, but allows for the escape of the thickened edge should the door panel be impacted.

According to another aspect of the invention, the substantially rectangular portion, which may include an angled side or triangular portion proximate the angled portion of the thickened edge, may be made from a different material than the angled portion. For example, the substantially rectangular portion may be made from a lower durometer material than the angled portion or vice versa.

According to another aspect of the invention, the substantially rectangular portion and the angled face may be two separate materials that are coextruded.

According to another aspect of the invention, the substantially rectangular portion and the angled face may be a single extrusion made using different materials, or alternatively, may be a single extrusion made from one material where one or both of the rectangular portion or the angled portion are treated or impregnated with a chemical or additive altering its durometer and/or coefficient of friction.

According to another aspect of the invention, the angled face may be ribbed or include ribs which run vertically along a portion or substantially the entirety of the thickened side edge. Located between each rib may be a channel, groove, or other opening capable of allowing the ribs to deform to disengage the thickened edge and door panel from the side column when an extreme force is applied to the door panel. It is also contemplated that these ribs can be interrupted along the angled face.

Other aspects and features of the invention will become apparent to those having ordinarily skill in the art upon review of the following Description, Claims, and associated Drawings.

BRIEF DESCRIPTION OF THE DRAWINGS

FIG. 5A is a cross-sectional view of an embodiment of a thickened edge wind lock taken along line 3-3 in FIG. 1;

FIG. 5B is a cross-sectional view of an embodiment of a thickened edge wind lock taken along line 3-3 in FIG. 1;

FIG. 5C is a cross-sectional view of an embodiment of a thickened edge wind lock taken along line 3-3 in FIG. 1;

FIG. 5D is a cross-sectional view of an embodiment of a thickened edge wind lock taken along line 3-3 in FIG. 1;

FIG. 5E is a cross-sectional view of an embodiment of a thickened edge wind lock taken along line 3-3 in FIG. 1;

FIG. 5F is a cross-sectional view of an embodiment of a thickened edge wind lock taken along line 3-3 in FIG. 1;

DETAILED DESCRIPTION OF THE PRESENT INVENTION

Figure 1:
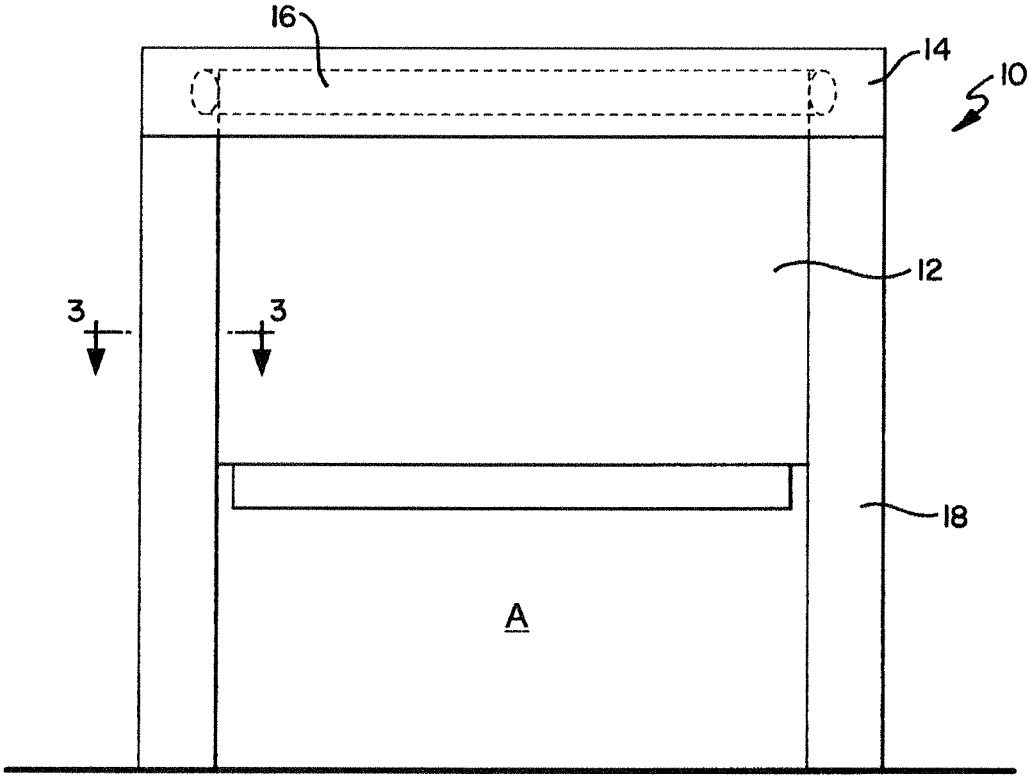
FIG. 1 is a front view of a door assembly as contemplated by the invention.

While the present invention is susceptible of embodiment in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

Figure 2:
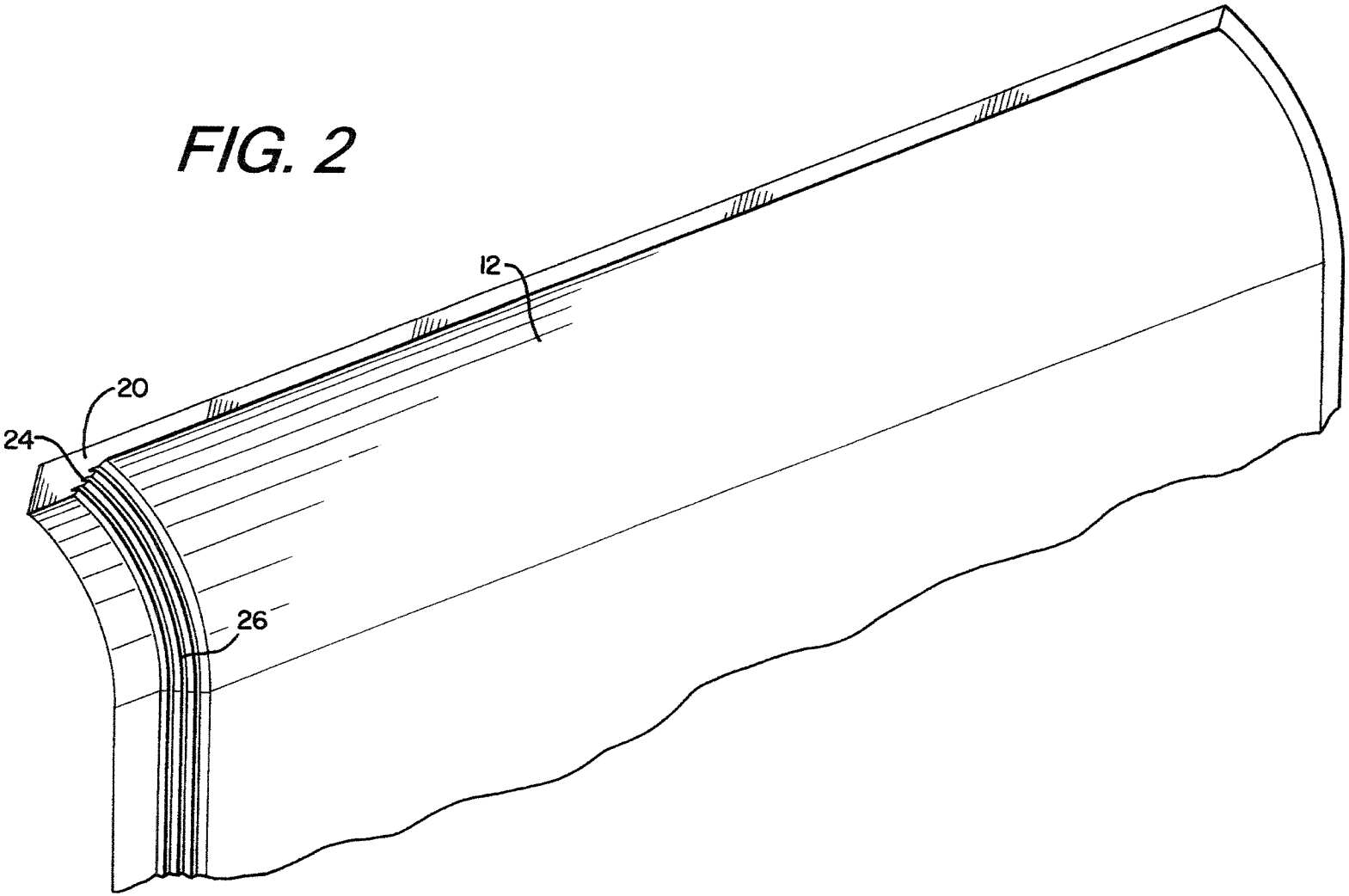
FIG. 2 is a perspective view of a portion of a door panel as contemplated by the invention.

FIG. 1 shows a door assembly 10 having a door panel 12, header 14 housing drum 16 (shown in phantom)—used for winding and unwinding the door panel to permit and prohibit access to an opening A and the wound or unrolled portion of door panel 12—and side columns 18 which engage and vertically guide door panel 12. As should be appreciated by those having ordinary skill in the art, door panel 12 includes a top edge, a bottom edge, and opposing marginal and lateral edges captured in side columns 18. As seen in FIG. 2, a portion of door panel 12 reveals how the door panel winds on drum 16 and shows the area proximate marginal edge 20. As seen in FIG. 2, each marginal edge 20 of door panel 12 includes a thickened edge wind lock 22 having angled portion 24 with angled face 26. The structure of thickened edge wind lock 22 may be better seen in FIG. 3 wherein the thickened edge and the side column are shown taken at line 3-3 in FIG. 1.

Figure 3:
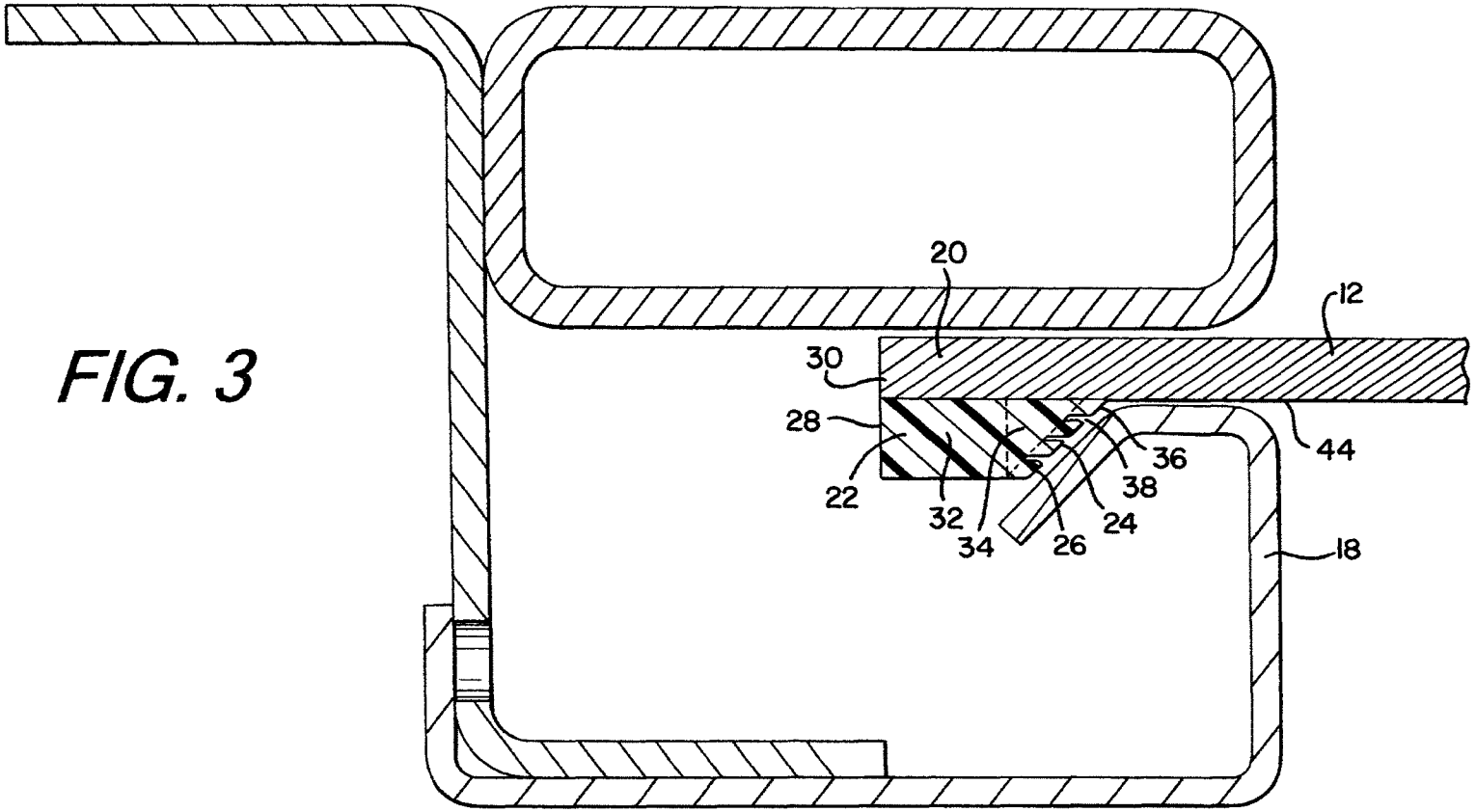
FIG. 3 is a cross-sectional view taken along line 3-3 in FIG. 1.
Figure 4:
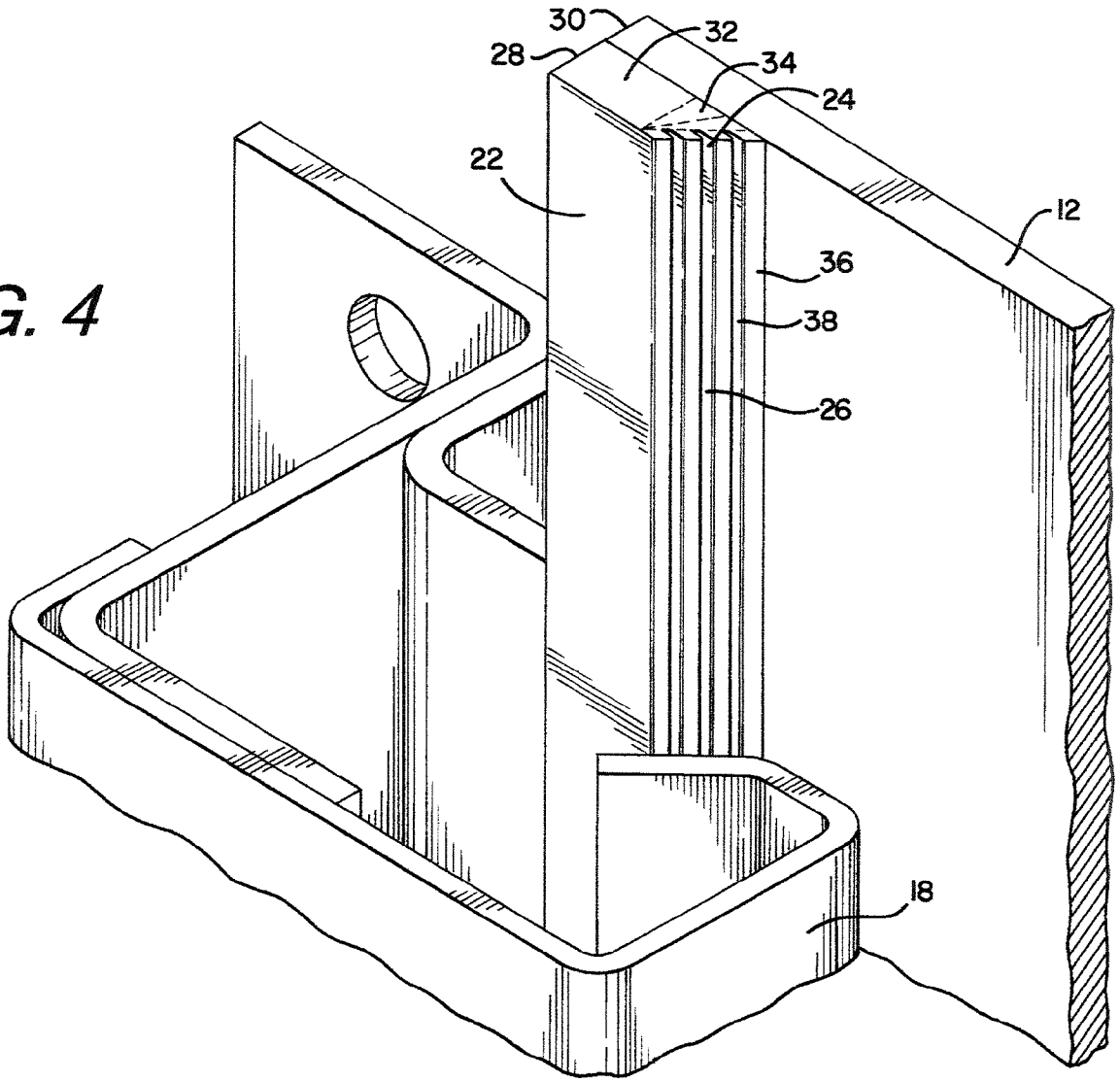
FIG. 4 is a perspective view of FIG. 3.

As seen in FIGS. 3 and 4, wind lock 22 further includes straight edge 28 aligning with lateral edge 30 of door panel 12, wherein straight edge 28 forms a face or boundary for substantially rectangular portion 32. While it is contemplated that substantially rectangular portion 32 may in fact be rectangular, it is contemplated by the invention that it may also include triangular portion 34 having an angled edge opposite straight edge 28 wherein the angled edge of triangular portion 34 may be substantially parallel to angled face 26.

In some embodiments of the invention, in order to reduce wear and insure a complete wind lock while maintaining enhanced breakaway-ability, it is contemplated that rectangular portion 32 has a different durometer than angled portion 24 and angled face 26. If high wind resistance is required, it is contemplated that angled portion 24 and angled face 26 may be made of a higher durometer material, like for example 95 durometer material, than rectangular portion 32, which may be, for example made from a 65 durometer material. Using a higher durometer material for angled portion 24 results in angled face 26 being more wear resistant, i.e. wears less as a result of friction, and in angled portion 24 being capable of withstanding higher wind loads and providing resistance to larger forces than rectangular portion 32. While the higher durometer material may be less pliable and result in some loss of disengage-ability, the sloped nature of angled face 26 and the lower durometer of rectangular portion 32 allows for wind lock 22 to deform and disengage when an object impacts door panel 12.

In embodiments where wind load and frictional wear are less of a concern but the ability to disengage from impacts on the door panel from objects is of great concern, it is contemplated by the invention that angled portion 24 may have a lower durometer than rectangular portion 32 in order to more easily facilitate disengagement if door panel 12 is impacted. However, in such embodiments, it should be understood by a person having ordinary skill in the art that rectangular portion 32 should be made sufficiently pliable so as to deform enough to allow for wind lock 22 to disengage to release from side column 18 and allow door panel 12 to disengage from side column 18 if door panel 12 is excessively impacted.

As should be appreciated by those having ordinary skill in the art, the wind lock capabilities and disengage-ability of wind lock 22 and door panel 12 may also be adjusted by modifying the size of rectangular portion 32 and angled portion 24. For example, where some wind lock capabilities are required but disengage-ability is of the utmost importance, it is contemplated by the invention that angled portion 24 may be made of a higher durometer material but made relatively narrow, or even only include angled face 26. In such embodiments, rectangular portion 32 would further include triangular portion 34 with the angled face of triangular portion 34 substantially in contact with angled face 26.

Alternatively, where wind lock is the most important requirement and disengage-ability is of less concern, angled portion 24 may be made of a higher durometer and extend deeper into wind lock 22, and may, for example, include all of triangular portion 34. Extending angled portion 24 deeper into wind lock 22 creates a harder, more dense portion of wind lock 22, making the deformation and disengagement of wind lock 22 and door panel 12 more difficult, i.e. increasing the wind lock capabilities.

In some embodiments, it is contemplated that angled portion 24 may extend deeper into wind lock 22 than triangular portion 34, or, that a section of triangular portion 34 is part of angled portion 24 and a section of triangular portion 34 is part of rectangular portion 32. Essentially, the size and depth of any higher or lower durometer materials may be adjusted based upon the requirements of the door where the door is installed.

In yet further embodiments, it may be desirable that triangular portion 34 be made from a third durometer, like for example somewhere between a higher durometer angled portion 24 and a lower durometer rectangular portion 32. Making triangular portion 34 from a different durometer than angled portion 24 and rectangular portion 32 may allow for enhanced wind lock capabilities and/or enhanced disengage-ability of the door panel.

Materials which may be used to create thickened edge wind lock 22 and angled portion 24 and rectangular portion 32 include but are not limited to: rubber; Polyvinyl Chloride ("PVC") polymers; foams; or other polymers or plastics. It should be by those having ordinary skill in the art that any semi-rigid, resilient material may be used for wind lock 22, so long as the material is capable of holding door panel 12 in place when a wind load is applied to door panel 12, while being capable of deforming and/or compressing if an object strikes door panel 12 and reforming once the wind load and/or object force is removed from door panel 12.

In order to form the dual-durometer thickened edge, it is contemplated by the invention that any means known in the art may be used. For example, rectangular portion 32, including any part of triangular portion 34, may be made from a different material than angled portion 24 and the two portions and materials may be co-extruded as a single body. Alternatively, rectangular portion 32 may be made from a different material than angled portion 24 and created using a single extrusion. As a further alternative, it is contemplated by the invention that rectangular portion 32 may be made from the same material as angled portion 24 and the durometer of either the rectangular portion or the angled portion (and whatever triangular portion 34 is needed for the requirements of the door), or both, may be altered by applying or impregnating either or both with chemicals or other substances which react with the material of thickened edge to increase or decrease the durometer of one or both portions of thickened edge 22. Such an additive can be selected to also provide a decrease in the coefficient of friction if desired. As yet a further alternative, the physical properties of angled portion 24 and rectangular portion 32 may be altered or manipulated to adjust the durometer of either by applying, for example, extreme heat or extreme cold to one or both portions.

As previously described, it is further contemplated by the invention that in some embodiments angled portion 24, and in particular angled face 26 may be coated with a friction reducing material to facilitate the disengagement of thickened edge 22 and door panel 12 with side column 18 and to further protected angled face 26 from wear. Examples of materials that may be used include a silicon spray or a lubricant. However, it is also contemplated that a chemical additive, as would be understood to those in the art, may be applied to alter the surface coefficient of friction of at least a portion of the angled face.

Regardless of whether any additive or chemical alteration is used to reduce friction, it is contemplated by the invention that to further facilitate the disengagement of thickened edge 22 and door panel 12 from side column 18 if door panel 12 is impacted by an object while maintaining a necessary wind load resistance, that angled portion 24 and/or angled face 26 may contain at least two ribs 36 and at least one channel or groove 38. While shown as four ribs and three channels or grooves in FIGS. 2-4, any number n ribs may be utilized with n−1 channels or grooves located there between. Utilizing ribs 36 and grooves 38 is particularly advantageous where angled portion 24 and angled face 26 are made of a higher durometer material to enhance and insure a proper wind lock, because grooves 38 provide space for ribs 36 to easily compress and deform to slip out and disengage from side column 18 if door panel 12 is impacted by an object. In order to further facilitate disengagement, it is further contemplated that a portion of each rib 36 may be rounded (or otherwise altered) to facilitate rolling and easier escape from side column 18.

When utilizing ribs 36, it should also be appreciated that multiple wind loads may be resisted by the door panel. For example, under low wind loads only a single of the four ribs seen in FIGS. 2-4 may be engaged with side column 18, while under moderate or heavy wind loads the uppermost ribs 36 may begin to compress causing additional ribs to engage. Each rib compressing and engaging the next rib will create a different torsional force on wind lock 22, as well as create friction between each compressed rib 36 to further hold door panel 12 in side columns 18 as the wind load increases. Of course, once each rib 36 is compressed, such as when an object impacts door panel 12, wind lock 22 may be configured to be smaller than the gap between door panel 12 and side column 18, allowing door panel 12 and thickened edge 22 to slip out of side column 18.

It is contemplated by the invention that the ribs may have different thicknesses or durometers to promote increased wind load capabilities while insuring the disengage-ability of door panel 12. For example, ribs 36 may increase in thickness and/or from a lower durometer to a higher durometer as they approach the door panel. Placing thinner and/or lower durometer ribs further from the door allows for those ribs to more easily deform and compress on impact, while using higher durometer ribs closer or right on door panel 12 allows for wind load to be maximized when it is needed most, i.e. when the wind is blowing or gusting enough to force all or nearly all of the ribs to compress due to the wind load while still maintaining door panel 12 in side columns 18.

Utilizing ribs 36 and grooves 38 also allows for angled portion 24 and angled face 26 to deform when door panel 12 is wound in a substantially open position, reducing the size of the rolled up door and eliminating any creasing or buckling from the thickened edge rolling up with door panel 12. As should also be appreciated by those having ordinary skill in the art, ribbing angled portion 24 also reduces the total weight of door panel 12 and thickened edge 22 inasmuch as grooves 38 weigh much less than any solid thickened edge material.

FIGS. 5A-5F show various embodiments of the cross-section along line 3-3 of FIG. 1 of thickened edge 22. As seen, the size and shape of ribs 36 may be altered to promote wind load or facilitate disengage-ability with side column 18. For example, as seen in FIGS. 5A and 5B respectively, ribs 36 may be shorter and less or longer and more angled. Adjusting the size and shape of the ribs affects the disengage-ability and wind lock capabilities of door panel 12.

As discussed above, the thickness of ribs 36 and grooves 38 may also be adjusted. However, it should be appreciated by those having ordinary skill in the art that the thickness of the completely compressed ribs should preferably be less than or equal to a gap (shown as gap 44 in FIG. 3) between side column 18 and door panel 12. In assemblies where the thickness of each rib is substantially identical, the total combined thicknesses of the ribs may be equal to the size of the gap between door panel 12 and the face of side column 18 which engages the ribs, divided by the number of ribs. For example, if four ribs are utilized and the gap between door panel 12 and side column 18 is 0.5 inches, the thickness of each rib may be 0.125 inches or a quarter of the 0.5 inch gap. In embodiments where the size of the ribs varies, the total thickness of each rib would be equal to 0.5 inches. For example, a first rib may be 0.075 inches, a second rib 0.1 inches, 0.225 inches, and 0.1 inches. Of course it is contemplated by the invention that each rib has a different thickness. As should be appreciated by those having ordinary skill in the art, the size of the gap between each rib may be altered as well. Where thicker or thinner ribs are required to withstand a larger wind load or to enhance disengage-ability, it contemplated by the invention that narrow gaps or grooves may be utilized to adjust the disengage-ability accordingly. Notwithstanding the foregoing, the total thickness of the ribs may be the same or even slightly larger than the gap—especially if a friction reducing material is applied.

It should be appreciated by those having ordinary skill in the art that the configuration of ribs 36 may also be changed. For example, rather than be angled and facing side column 18, it is contemplated by the invention that ribs 36 may extend vertically from rectangular portion 32 and engage side column 18. In such embodiments, ribs 36 may compress in a downwards direction to allow door panel 12 to escape side column 18 if struck, or alternatively may bend or be folded backwards, allowing escape that way. Essentially, ribs 36 may be orientated in any manner that allows them to compress, deform, and escape side column 18 when door panel 12 is struck while maintaining door panel 12 in place when a wind load is applied to the panel.

Additionally, in order to further enhance disengage-ability, rectangular portion 32 may contain a hollow channel or multiple hollow channels 40 to facilitate disengage-ability of thickened edge 22. As should be appreciated by those having ordinary skill in the art, altering the size of the channels and the thickness of the walls surrounding the same will alter the durometer and strength of thickened edge 22 and adjusting the same can be used to create a wind lock which is capable of standing up to the necessary wind load while still promoting disengage-ability if door panel 12 is impacted by an object.

As seen in FIG. 5E, where ease of disengage-ability is required, it is contemplated by the invention that portion 42 of rectangular portion 32 be removed entirely. In such embodiments, it is contemplated that not only ribs 36 deform and compress, but also that rectangular portion 32 compresses in direction R in order to facilitate disengagement from side column 18 if door panel 12 is impacted by an object.

As should be appreciated by those having ordinary skill in the art, using channels 40 in, or removing portion 42 from rectangular portion 32 further reduces the weight of the thickened edge, reducing the strain on the motor driving the door panel and any strain on drum 16 or door panel 12 itself.

Though using a rib like surface is preferred, as seen in FIG. 5F, it is contemplated by the invention that angled portion 24 may be flat and contain no ribs, provided it is made of a material having a different durometer than rectangular portion 32. In such embodiments, the depth of angled portion 24 will have great affect on the wind lock capabilities and disengage-ability of door panel 12. For example, in embodiments where wind load is of little concern, only angled face 26 may be made from a higher durometer material for the purposes of increasing the wear capabilities of wind lock 22 while insuring maximum disengage-ability.

In operation, door assembly 10 having thickened edge wind locks 22 works as follows. FIG. 6A shows door panel 12 in an ordinary position, resting in side column 18 having gap 44 between door panel 12 and the portion of side column 18 that engages wind lock 22. As shown in FIG. 6A, when there is no wind load and no objects are striking door panel 12, wind lock 22 freely sits in side column 18, substantially unengaged with any portion thereof.

Figure 6B:
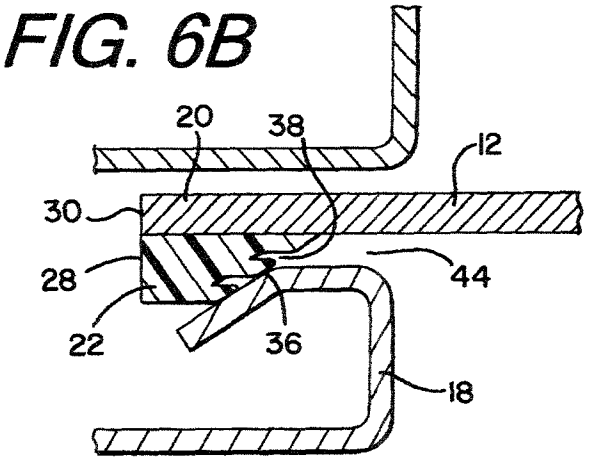
FIG. 6B shows a cross-sectional view taken along line 3-3 in FIG. 1 of an embodiment of the interaction between a door panel, a thickened edge wind lock, and a side column when a wind load is applied to the door panel.

Once a wind load is applied to the door, as shown in FIG. 6B, angled portion 24 and angled face 26 engage side column 18 to prevent door panel 12 from escaping side column 18. As shown in FIG. 6B, under moderate or heavy winds, one or more of ribs 36 may begin to deform and compress under the wind load, however so long as less than the total number of ribs are compressed, wind lock 22 will hold door panel 12 in place within side columns 18. As explained above, as the ribs begin to compress and close grooves 38 and rub together, additional frictional forces may be recognized between each rib creating resistance to further compression and/or disengagement from side column 18 in the face of less than full compression.

Figure 6D:
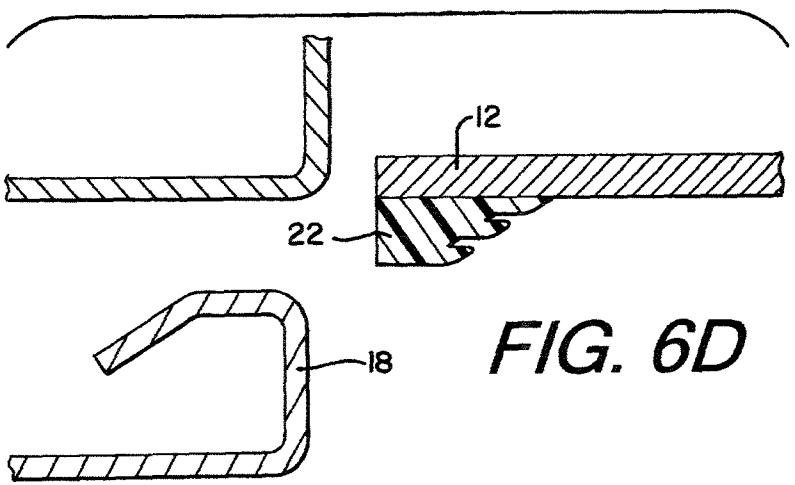
FIG. 6A shows a cross-sectional view taken along line 3-3 in FIG. 1 of an embodiment of the interaction between a door panel, a thickened edge wind lock, and a side column when no forces are applied to the door panel.
FIG. 6C shows a cross-sectional view taken along line 3-3 in FIG. 1 of an embodiment of the interaction between a door panel, a thickened edge wind lock, and a side column when the door panel is impacted; and, FIG. 6D shows a cross-sectional view taken along line 3-3 in FIG. 1 of an embodiment of the interaction between a door panel, a thickened edge wind lock, and a side column when the door panel is disengaged from the side column.
Figure 6A:
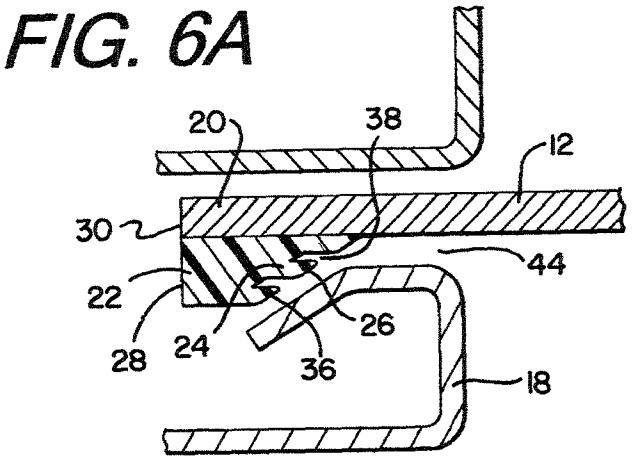
Figure 6C:
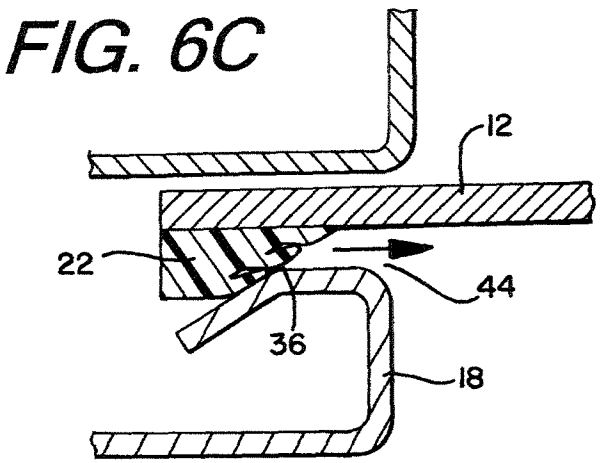

Once an object impacts door panel 12, as shown in FIG. 6C, ribs 36 fully compress allowing door panel 12 and wind lock 22 to escape from side column 18 to prevent damage to the door panel, the side column, the objet striking the door or any other door components. As shown in FIG. 6D, once fully compressed, wind lock 22 and door panel 12 can escape side column 18 and freely release in response to an impact force.

The above-described embodiments of the present invention are intended to be examples only. Alterations, modifications and variations may be effected to the particular embodiments by those of ordinary skill in the art without departing from the scope of the invention, which is defined by the claims appended hereto.

What is claimed is:

1. An overhead roll-up door assembly for a vertically moving door to permit and prohibit access to an opening, the door assembly comprising:

a door panel having two faces, a top edge, a bottom edge, and opposing marginal and lateral edges, the door panel having at least one wind lock attached proximate each marginal edge, each of the wind locks being a single extruded body having a first portion and a second portion;

a drum for winding and unwinding the door panel to permit and prohibit access to the opening; and, a pair of opposing parallel side columns aligned and spaced apart such that at least a portion of the lateral and marginal edges of the door panel are guided between the open and closed position by the opposing parallel side columns, wherein at least the first portion of each wind lock has a first durometer, and at least the second portion of each wind lock has a second durometer, different from the first durometer.

2. The overhead roll-up door assembly of claim 1 wherein the first portion and the second portion of each wind lock are coextruded from separate materials.

3. The overhead roll-up door assembly of claim 1 wherein the first portion is treated with a friction reducing material.

4. The overhead roll-up door assembly of claim 1 wherein the first portion and the second portion of each wind lock are a single extruded piece.

5. The overhead roll-up door assembly of claim 1 wherein the first durometer is a lower durometer than the second durometer.

6. The overhead roll-up door assembly of claim 1 wherein the second portion of at least one of the wind locks includes at least one hollow channel running along substantially the entire vertical length on an interior of the second portion.

7. The overhead roll-up door assembly of claim 1 wherein the second portion of at least one wind lock includes at least four hollow channels running along substantially the entire vertical length on an interior of the second portion.

8. The overhead roll-up door assembly of claim 1 wherein the wind locks substantially extend continuously from the top edge of the door panel to the bottom edge of the door panel.

9. The overhead roll-up door assembly of claim 1 wherein the first durometer is a higher durometer than the second durometer.

10. The overhead roll-up door assembly of claim 9 wherein a chemical or additive is applied to, or impregnated in, the first portion to form the higher durometer.

11. The overhead roll-up door assembly of claim 1 wherein the first portion includes at least two ribs facing an interior of the opening, the at least two ribs being configured so as to form a channel there between, the at least two ribs running vertically along the first portion from approximately the top edge of the door panel to approximately the bottom edge of the door panel, in an interrupted fashion there between.

12. The overhead roll-up door assembly of claim 11 wherein the at least two ribs are compressible so as to allow the at least two ribs to deform and compress, including collapsing the channel formed there between, to allow the at least one wind lock and the door panel to:

disengage from the side columns should the door panel be impacted by an object imposing an outside force; and, properly wind on the drum as the door panel opens.

13. The overhead roll-up door assembly of claim 11 wherein each of the at least two ribs includes a rounded portion, the rounded portion:

increasing the torsion force created by the associated wind lock resulting from engagement with the side columns when a wind load is applied to the door panel and thereby increasing the wind resistance of the door panel; and, facilitating the disengagement of the at least one wind lock and the door panel from the side column if the door panel is impacted by an object imposing an outside force.

14. The overhead roll-up door of claim 11 wherein the at least two ribs each have a different durometer than the other rib.

15. The overhead roll-up door assembly of claim 11 wherein the first portion includes n ribs and n−1 channels.

16. The overhead roll-up door of claim 15 wherein each of the n ribs have a different durometer than the other ribs.

17. A door panel for an overhead roll-up door assembly, the door panel comprising:

a panel having two faces, a top edge, a bottom edge, and opposing marginal and lateral edges;

at least one wind lock attached proximate each marginal edge of the panel, the wind locks having a thickened body and an angled face, the angled face facing away from the lateral edge of the panel wherein the thickened body and the angled face have different durometers, and each wind lock is a single extruded body.

18. A thickened edge wind lock for use on an overhead roll-up door in an overhead roll-up door assembly, the thickened edge wind lock comprising:

a rectangular portion having a first durometer;

an angled portion having a second durometer different from the first durometer;

wherein the wind lock is a single extruded body and the different durometers are obtained by at least one from the group consisting of: manufacturing the rectangular portion and the angled portion from different materials; impregnating one or both of the rectangular portion and the angled portion with a chemical reactive with the material of the impregnated portion; applying a coating to one or both of the rectangular portion and the angled portion; and, altering the physical properties of one or both of the rectangular portion and the angled portion.

* * * * *